US009719152B2

(12) United States Patent
Fredriksson et al.

(10) Patent No.: US 9,719,152 B2
(45) **Date of Patent: *Aug. 1, 2017**

(54) METHOD, ARRANGEMENT, AND PELLETISING PLANT

(71) Applicant: LUOSSAVAARA-KIIRUNAVAARA AB, Luleå (SE)

(72) Inventors: Christian Fredriksson, Luleå (SE); Stefan Savonen, Svappavaara (SE)

(73) Assignee: LUOSSAVAARA-KIIRUNAVAARA AB, Lulea (SE)

( * ) Notice: Subject to any disclaimer, the term of this patent is extended or adjusted under 35 U.S.C. 154(b) by 143 days.

This patent is subject to a terminal disclaimer.

(21) Appl. No.: 14/721,686

(22) Filed: May 26, 2015

(65) Prior Publication Data

US 2015/0252444 A1 Sep. 10, 2015

Related U.S. Application Data

(62) Division of application No. 13/881,713, filed as application No. PCT/SE2011/051273 on Oct. 26, 2011, now Pat. No. 9,068,243.

(30) Foreign Application Priority Data

Oct. 26, 2010 (SE) ..... 1051108

(51) Int. Cl.
*C22B 1/02* (2006.01)
*C22B 1/20* (2006.01)
(Continued)

(52) U.S. Cl.
CPC ..... *C22B 1/22* (2013.01); *C22B 1/02* (2013.01); *C22B 1/20* (2013.01); *C22B 1/212* (2013.01);
(Continued)

(58) Field of Classification Search
CPC ..... C22B 1/02; C22B 1/205; C22B 1/212
See application file for complete search history.

(56) References Cited

U.S. PATENT DOCUMENTS 3,782,888 A 1/1974 Cnare
3,947,001 A 3/1976 Leighton
(Continued)

FOREIGN PATENT DOCUMENTS

DE 102008019532 B3 * 10/2009
EP 0079264 A1 5/1983
(Continued)

OTHER PUBLICATIONS

Rausch, Rainer. DE 102008019532 B3. Published Oct. 1, 2009. Machine translation of the description.*
(Continued)

*Primary Examiner* — George Wyszomierski
*Assistant Examiner* — Tima M McGuthry Banks
(74) *Attorney, Agent, or Firm* — Morrison & Foerster LLP

(57) ABSTRACT

A method includes the introduction of a first medium into the compartment through an inlet and the heating of the first medium when it is present in the inlet. The heating takes place through the use of a combustion arrangement that is arranged in the inlet and that comprises fuel. The heating, the use of the combustion arrangement, includes in turn the ignition of the fuel, combustion of the fuel, and the transfer of the combustion heat to the first medium that is present at the combustion arrangement in the inlet. The combustion arrangement, is arranged in a region in the inlet, which in turn is arranged outside of the direct passage of the first medium in and through the inlet, such that the ignition of the fuel, the combustion of the fuel and the transfer of combustion heat to the first medium take place in this region.

12 Claims, 3 Drawing Sheets

(51) Int. Cl.

| | |
|---|---|
| ***C22B 1/22*** | (2006.01) |
| ***C22B 1/212*** | (2006.01) |
| ***F27B 9/30*** | (2006.01) |
| ***F27B 9/36*** | (2006.01) |
| ***F27B 21/00*** | (2006.01) |
| ***F27D 99/00*** | (2010.01) |

(52) U.S. Cl.
CPC ..... *F27B 9/3005* (2013.01); *F27B 9/36* (2013.01); *F27B 21/00* (2013.01); *F27D 99/0033* (2013.01)

(56) References Cited

U.S. PATENT DOCUMENTS

| | | | |
|---|---|---|---|
| 6,338,366 | B1 | 1/2002 | Williams |
| 2001/0032527 | A1 | 10/2001 | Fujioka et al. |

FOREIGN PATENT DOCUMENTS

| | | | |
|---|---|---|---|
| EP | 0079264 | B1 | 3/1986 |
| GB | 746841 | A | 3/1956 |
| JP | 11-325740 | A | 11/1999 |
| JP | 2010-163656 | A | 7/2010 |

OTHER PUBLICATIONS

Non Final Office Action received for U.S. Appl. No. 13/881,697, mailed on Oct. 21, 2014, 11 pages.
Non-Final Office Action received for U.S. Appl. No. 13/881,713, mailed on Jan. 13, 2015, 11 pages.
Notice of Allowance received for U.S. Appl. No. 13/881,713, mailed on Apr. 29, 2015, 7 pages.
Requirement for Restriction Election received for for U.S. Appl. No. 13/881,713 mailed on Oct. 28, 2014, 7 pages.
International Preliminary Report on Patentability received for PCT Patent Application No. PCT/SE2011/051273, mailed on May 10, 2013, 6 pages.
International Search Report and Written Opinion received for PCT Patent Application No. PCT/SE2011/051273, mailed on Feb. 14, 2012, 9 pages.
International Preliminary Report on Patentability received for PCT Patent Application No. PCT/SE2011/051275, mailed on May 10, 2013, 6 pages.
International Search Report and Written Opinion received for PCT Patent Application No. PCT/SE2011/051275, mailed on Feb. 14, 2012, 9 pages.
Notice of Allowance received for U.S. Appl. No. 13/881,697, mailed on Feb. 3, 2015, 5 pages.

* cited by examiner

METHOD, ARRANGEMENT, AND PELLETISING PLANT

CROSS REFERENCE TO RELATED APPLICATIONS

This is a divisional application of U.S. application Ser. No. 13/881,713, filed Apr. 25, 2013, now U.S. Pat. No. 9,068,243, which is a U.S. National Phase patent application of PCT/SE2011/051273, filed Oct. 26, 2011, which claims priority to Swedish Patent Application No. 1051108-7, filed Oct. 26, 2010, each of which is hereby incorporated by reference in the present disclosure in its entirety.

TECHNICAL AREA

This invention concerns a method and an arrangement for the heating of a medium in a compartment in which pellets are arranged to be oxidised and sintered with the aid of the hot medium. The invention concerns also a pelletising plant.

BACKGROUND

Iron ore concentrate, finely divided iron ore in powder form, from which undesired components of the ore have been removed, is mixed with water in a preparation plant in order subsequently to be processed in a pelletising plant is known.

The ore concentrate is dewatered in the pelletising plant and mixed with various additives and binding agents, and rolled to small pellets. The pellets are dried in a drying arrangement and heated in a compartment such that the pellets are oxidised and sintered, caused to melt together, one by one, to form final pellets, which maintain their shape during further transport. A cooling of the pellets subsequently takes pace in a cooling arrangement. The pellets are now ready and can be transported onwards to the locations at which the ore is to be further refined.

The use of an arrangement comprising an inlet connected to the compartment for introduction of a medium through the inlet and into the compartment is previously known. A combustion arrangement is arranged in the inlet for heating the medium. The combustion arrangement comprises fuel that, when the arrangement is in use, is ignited and combusted.

Combustion heat is developed during the combustion of the fuel, which heat is transferred to the medium that is present at the combustion arrangement in the inlet and that passes through the inlet on its way to the compartment.

The heating of the pellets in a compartment is a very critical step in the processing of the pellets and requires a relatively high temperature in order to obtain a good result, in order for the pellets to be durable.

DESCRIPTION OF THE INVENTION

One purpose of this invention is to offer a method, an arrangement and a pelletising plant that ensure a desired temperature in a compartment in which pellets are oxidised and sintered.

This is obtained with a method having the technical features that are described below.

Preferred embodiments of the invention will be described below with reference to the drawings.

DETAILED DESCRIPTION OF EMBODIMENTS

Figure 1:
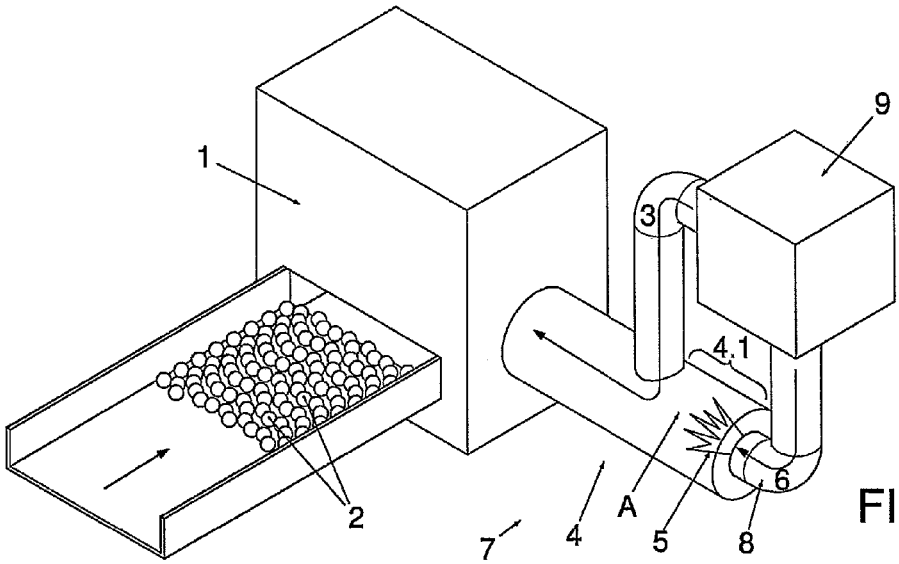
FIG. 1 shows an arrangement according to the invention.

A method and an arrangement according to this invention that will be described below will have the same function and intention independently of whether it is a pelletising plant with iron pellets of whether it is a more general sintering plant in which ore concentrate is not formed into pellets but where the ore concentrate is oxidised and sintered without first being formed.

The term "pelletising plant" in the description below is to be interpreted in its widest sense, which means that also a sintering plant is described by the term. The term "pellets" is also to be interpreted in its widest sense, such that also iron ore concentrate in random aggregates in a sintering plant is described by the term "pellets".

This invention concerns a method for the heating, in order to obtain a specific temperature that has been determined in advance and is the desired best temperature for the method, of a medium in a compartment 1 in which pellets 2 are arranged to be oxidised and sintered with the aid of the hot medium.

The method comprises the introduction of a first medium 3 into the compartment 1 through an inlet 4 and the heating of the first medium 3 when it is present in the inlet 4. The heating takes place through the use of a combustion arrangement 5, or a part of such an arrangement, that is arranged in the inlet 4 and that comprises fuel. The heating, the use of the combustion arrangement 5, comprises in turn the ignition of the fuel, the combustion of the fuel whereby combustion heat is developed, and the transfer of the combustion heat to the first medium 3 that is present at the combustion arrangement 5 in the inlet 4.

Figure 2:
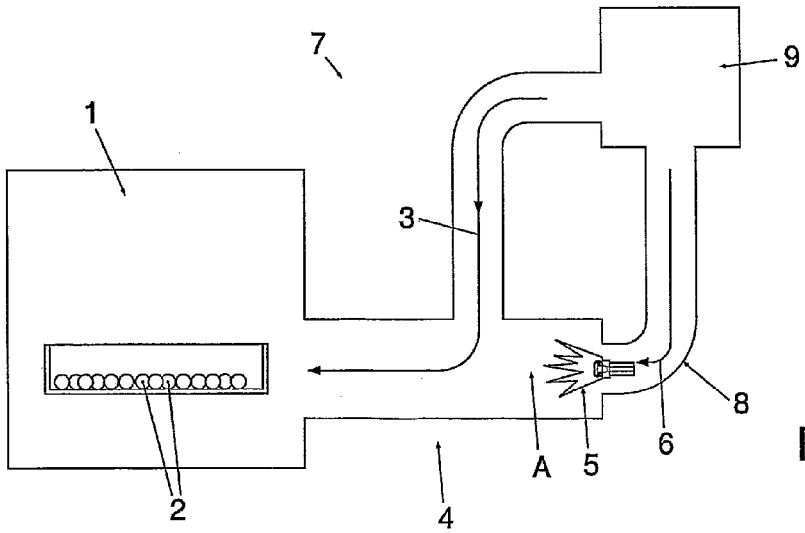
FIG. 2 shows a section through the arrangement in FIG. 1.

The combustion arrangement 5, or a part of it, is arranged in a region A in the inlet 4, which in turn is arranged outside of the direct passage of the first medium in and through the inlet 4, such that the ignition of the fuel, the combustion of the fuel and the transfer of combustion heat to the first medium 3 all occur in this region A, followed by onwards transport of the heated first medium 3 from the region A into the compartment 1 through the inlet 4. See FIGS. 1 and 2.

The arrangement of the combustion arrangement 5, or at least a part of it, in the relatively undisturbed region A in the inlet 4 but outside of the direct passage of the medium in the inlet means that the ignition and combustion of fuel take place in a region that is not directly influenced, disturbed, by the medium, the first medium 3 that passes in the inlet 4 on its way towards the compartment 1 in which the pellets 2 are located.

When the combustion arrangement 5 is arranged outside of the direct passage of the first medium in the inlet 4, the combustion of the fuel takes place with a lower volume of air than that which has been used previously. Also, the temperature of the first medium will be somewhat lower than previously when the combustion arrangement was located directly in the inlet 4 and in the direct pathway of the medium. This results in a lower flame temperature.

This location of the combustion arrangement, and the combustion that is a result of this, result, in turn, in a low NOx level in the residual medium that is removed from the compartment in which the pellets are oxidised and sintered.

The method comprises also the introduction of a second medium 6 in the direct vicinity of the combustion arrangement 5, or a part of it, in the region A where the ignition of the fuel, the combustion of the fuel take place and the transfer of the combustion heat to the second medium 6 takes place, together with onwards transport of the second medium 6 into the compartment 1 through the inlet 4.

The method comprises the mixture of the heated first medium 3 and the heated second medium 6 in the inlet 4 before or during its introduction into the compartment 1, or both before and during this introduction. This takes place through the media 3 and 6 being transported in common through the inlet 4 during a certain period so that the media have sufficient time to mix before, or just as, they are introduced into the compartment 1.

It is appropriate to preheat at least one of the first medium 3 and the second medium 6 before it is or they are introduced into the inlet 4, into the compartment A. This increases and stabilises the temperature of the medium that is heated by the combustion arrangement and that enters the compartment 1. The best result is obtained if the first medium 3 is preheated to a higher temperature than the second medium 6, most preferably to a temperature in the interval 500-1500° C.

The introduction of the media 3 and 6 takes place continuously. It is appropriate to use air as medium since the oxygen in the air stimulates and improves the combustion in the combustion arrangement 5, which in turn gives a more even result of the heating and a higher temperature of the medium that is introduced into the compartment 1.

At least one of the media 3 and 6 is heated directly at the combustion arrangement 5 through the combustion of the fuel. The fuel is combusted continuously, and it is appropriate to use oil or gas as fuel in the combustion arrangement 5. Since oxidation and sintering are two processes that take place continuously, it is advantageous that also various process stages take place continuously. The use of air, oil and gas is easy and stable throughout the process, since it is easy to measure and use these substances in continuous processes.

The invention concerns also an arrangement 7 intended to be used for the heating of, for the acquirement of a high temperature of, a medium in a compartment 1 in which pellets 2 are arranged to be oxidised and sintered with the aid of the hot medium.

The arrangement 7 comprises an inlet 4 connected to the compartment 1 for the introduction of a first medium 3 through the inlet 4 and into the compartment 1.

The arrangement 7 comprises also a combustion arrangement 5 for the heating of the first medium 3 when it is present in the inlet 4, where the combustion arrangement 5 comprises fuel that, during the use of the arrangement 7, is ignited and combusted whereby combustion heat is developed, and is transferred to the first medium 3 that is located at the combustion arrangement 5 in the inlet 4. The inlet 4 comprises a region A, arranged outside of the direct passage of the medium in and through the inlet 4, in which the combustion arrangement 5, or at least a part of it, is arranged such that the ignition of the fuel, the combustion of the fuel and the transfer of combustion heat to the first medium 3 all occur in this region A, followed by onwards transport of the heated first medium 3 from the region A into the compartment 1 through the inlet 4.

This arrangement 7 makes it possible to carry out the method that has been described above and it results also in the advantages of the method that have been described.

The inlet 4 comprises an extension 4.1 that originates at a protruding part of the inlet 4 and whose interior makes available the region A. Thus the inlet has a different design and arrangement of space than those previously known. The extension 4.1 gives the inlet 4 a longer shape, and makes it possible to locate the combustion arrangement 5 behind the passage of the first medium into and through the inlet 4 and into a relatively calm region A.

The combustion arrangement 5, or at least a part of it, is arranged at the innermost side 4.1*a* of the extension, and faces principally away from the connection of the inlet with the compartment 1.

The arrangement 7 comprises an intake 8 arranged in connection with the region A through which a second medium 6 is introduced in the direct vicinity of the combustion arrangement 5, or a part of it, in the region A in which ignition and combustion of the fuel take place. The intake 8 is arranged at the innermost side 4.1*a* of the extension, and faces principally away from the connection of the inlet with the compartment 1.

Figure 3:
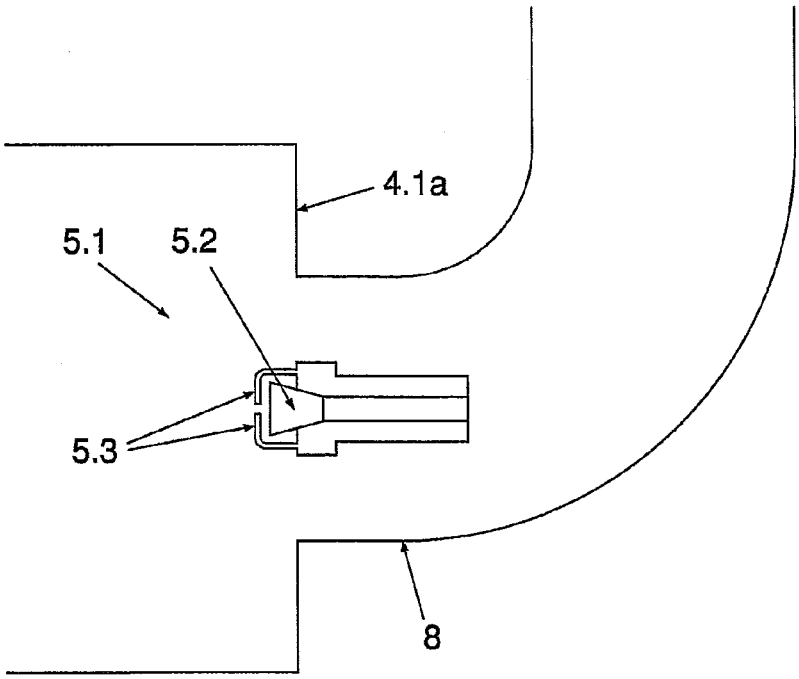
FIG. 3 shows a part of the combustion arrangement.

The combustion arrangement 5 comprises a component 5.1 that in turn comprises a nozzle 5.2 through which fuel is fed out into the combustion arrangement 5. The combustion arrangement 5 may comprise also an ignition arrangement 5.3 that ignites the fuel. This is normally not necessary, since the temperature in the inlet 4 is so high that the fuel is ignited without a special ignition arrangement. The component 5.1 constitutes the part of the combustion arrangement 5 that is arranged in the inlet 4, in the region A. See FIG. 3.

It is appropriate that the arrangement 7 comprise a preheating arrangement 9 that heats at least one of the first medium 3 before it is introduced into the inlet 4, and the second medium 6 before it is introduced into the inlet 4, the region A.

The limiting parts of the arrangement, the parts that limit the inlet 4, the region A and the intake 8, among others, are principally manufactured from tubular sheet metal, and the parts are lined with ceramic material.

Figure 4:
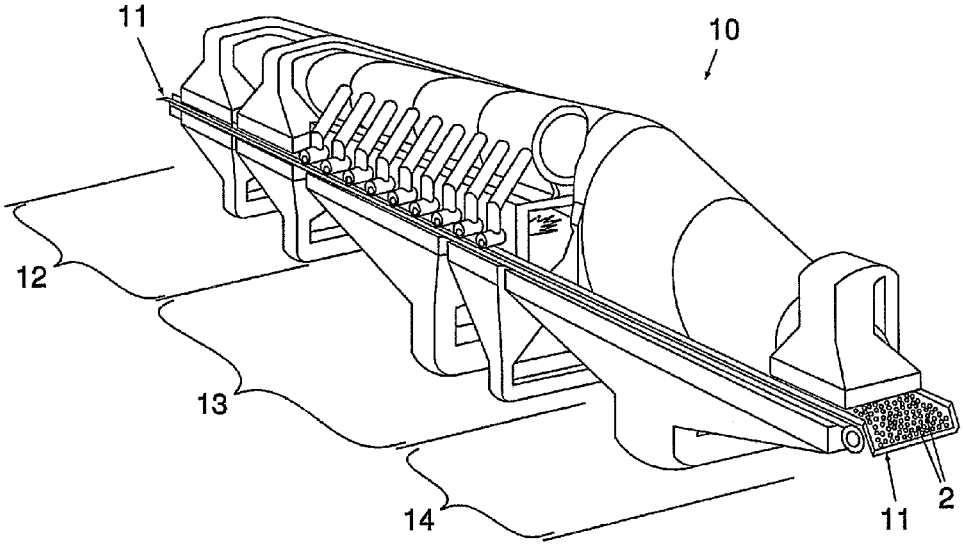
FIG. 4 shows a pelletising plant according to the invention.

The invention concerns also a pelletising plant 10 comprising an arrangement 7 describe above. See FIG. 4.

The pelletising plant 10 is of the "straight grate plant" type, and comprises a belt transporter 11 on which pellets 2 are transported through the complete pelletising plant 10, a drying arrangement 12 in which the pellets 2 are dried and may optionally be preheated, an oxidation and sintering part 13 that comprises the compartment 1, and a cooling arrangement 14 that follows this sintering part.

This description of different embodiments of the invention and alternative designs of its items and methods is not to be seen as a limitation of the invention: it is to be interpreted in its broadest meaning in order not to limit unnecessarily the protective scope according to the attached patent claims. Changes that lie within the expertise of a person skilled in the arts lie within the protective scope of the innovative concept. The various designs of items that are given in the description above can be used and combined freely, as long as the desired function is obtained.

The invention claimed is:

1. A method for heating of a medium in a compartment in which iron ore pellets are arranged to be oxidized and sintered with the aid of the medium, the method comprising:

introducing a first medium into the compartment through an inlet connected to the compartment;

heating the first medium in the inlet using a combustion arrangement or a part thereof arranged in the inlet, wherein the combustion arrangement or a part thereof comprises fuel, where the using of the combustion arrangement or a part thereof comprises the ignition of the fuel, combustion of the fuel, whereby combustion heat is developed, and transfer of the combustion heat to the first medium at the combustion arrangement or a part thereof; and placing, during the heating of the first medium, the combustion arrangement or a part thereof in a region in the inlet that, in turn, is arranged outside of a direct passage of the first medium in and through the inlet such that the ignition of the fuel, the combustion the fuel and the transfer of combustion heat to the first medium take place in this region, followed by onward transport of the heated first medium from the region into the compartment through the inlet.

2. The method according to claim 1, comprising the introduction of a second medium in the direct vicinity of the combustion arrangement or a part thereof in the region where the ignition of the fuel, the combustion of the fuel take place and the transfer of the combustion heat to the second medium takes place, together with onwards transport of the second medium into the compartment through the inlet.

3. The method according to claim 2, comprising the mixture of the heated first medium and the heated second medium in the inlet before or during its introduction into the compartment, or both before and during this introduction.

4. The method according to claim 3, comprising preheating of the first medium to a temperature that is higher than that of the second medium.

5. The method according to claim 2, comprising preheating of at least one of the first medium and the second medium before it is or they are introduced into the inlet.

6. The method according to claim 5, comprising preheating of the first medium to a temperature of 500-1500° C.

7. The method according to claim 1, where the introduction of the first medium takes place continuously.

8. The method according to claim 1, comprising using air as a medium.

9. The method according to claim 1, comprising direct heating of the first medium during combustion of the fuel.

10. The method according to claim 1, comprising continuous combustion of the fuel.

11. The method according to claim 1, comprising the use of oil or gas as fuel.

12. The method according to claim 1, wherein a gas resulting from the combustion of the fuel is introduced into the inlet.

* * * * *